US005420601A

United States Patent [19]

Amano

[11] Patent Number: 5,420,601

[45] Date of Patent: May 30, 1995

[54] METHOD OF DRIVING INDICATOR TUBE

[75] Inventor: Yoshifumi Amano, Tokyo, Japan

[73] Assignee: Technology Trade and Transfer Corporation, Tokyo, Japan

[21] Appl. No.: 113,987

[22] Filed: Aug. 30, 1993

[30] Foreign Application Priority Data

Sep. 29, 1992 [JP] Japan ..... 4-300266

[51] Int. Cl.[6] ..... G09G 3/22

[52] U.S. Cl. ..... 345/60; 345/67; 315/169.1; 313/582

[58] Field of Search ..... 345/60, 61, 62, 63, 345/66, 67, 68; 315/169.1, 169.4; 313/581, 582, 584, 585

[56] References Cited

U.S. PATENT DOCUMENTS

| | | | |
|---|---|---|---|
| 3,753,041 | 8/1973 | Lustig et al. | 345/62 |
| 3,781,587 | 12/1973 | Lustig et al. | 345/60 |
| 4,315,259 | 2/1982 | McKee et al. | 345/67 |
| 4,329,616 | 5/1982 | Holz et al. | 345/60 |
| 5,077,553 | 12/1991 | Buzak | 345/60 |

*Primary Examiner*—Ulysses Weldon
*Assistant Examiner*—Xiao M. Wu
*Attorney, Agent, or Firm*—Bauer & Schaffer

[57] ABSTRACT

A method of driving an indicator tube comprised of a pair of common memory electrode plates and independent address XY electrode groups separate therefrom comprises the steps of, in a case where an address discharge is to be carried out by the XY electrode groups from a state that no wall charge uniformly exists on wall surfaces of the pair of memory electrodes in all cells on a picture screen or on a line to be addressed, holding one of the pair of memory electrodes at a potential higher than a discharge space potential generated by an address discharge in a range such that a discharge is not caused on the low voltage side of the address electrode during an address period, holding the other of the pair of memory electrodes at a potential lower than the discharge space potential in a range such that a discharge is not caused on the high voltage side of the address electrode, selectively accumulating charged particles generated by the address discharge in cells disposed at the positions corresponding to an image as negative and positive wall charges, and continuously effecting a display discharge, or memory discharge utilizing a presence or absence of the wall charges as position information.

2 Claims, 9 Drawing Sheets

METHOD OF DRIVING INDICATOR TUBE

BACKGROUND OF THE INVENTION

1. Field of the Invention

The present invention relates to a method of driving an indicator tube.

2. Description of the Prior Art

A so-called AC type PDP (plasma display panel) utilizing wall charges and having a memory function is a two-electrode type plasma display panel in which XY electrodes are respectively disposed on both front and rear glass plates in an opposing fashion. Further, there is proposed a plasma display panel of a three-electrode surface type that is the development of the AC type plasma display panel. FIG. 1 of the accompanying drawings shows a fundamental structure of such conventional plasma display panel of the three-electrode surface type. As shown in FIG. 1, this plasma display panel comprises a first electrode 9 and a second electrode 10 disposed parallelly on the same plane of a front glass plate 5, an insulating layer 12 covering the surfaces of the first and second electrodes 9, 10 and an address electrode 11 formed on a rear glass plate 6 opposing the front glass plate 5, the electrode surface of the address electrode 11 being exposed to the outside. The address electrode 11 and the first electrode 9 constituting an XY matrix, and the second electrode 10 is commonly connected to each of the lines as a memory electrode.

Fundamental operation of this plasma display panel is such that a discharge occurred selectively between the address electrode 11 and the first electrode 9 is held between the first and second electrodes 9 and 10. That is to say, the first electrode 9 functions as both an address and a memory. Let it now be assumed that a memory discharge is continuously carried out between the first and second electrodes 9 and 10 and that wall charges exist on both the first and second electrodes 9, 10. Then, let us consider the case that the memory discharge or the wall charge is erased selectively. To erase the discharge, there is used a so-called self-erasure method in which a potential of the first electrode 9 is held at a proper potential immediately after a discharge was produced between the address electrode 11 and the first electrode 9 by a pulse having a very short duration to thereby erase the wall charge on the first electrode 9.

FIG. 2 is a timing chart of waveforms of driving signals according to the typical conventional driving method. As shown in FIG. 2, in order to accumulate wall charges in all cells, a pulse having a sufficient peak value is applied between the first and second electrodes 9, 10. Also, in order to selectively erase the wall charges, an address pulse is applied between the address electrode 11 and the first electrode 9. A duration of the address pulse is very important because if the duration of the address pulse is too short, an erasure discharge is disabled while if it is too long, the wall charge is accumulated on the first electrode 9 one more time.

To solve the problems encountered with the conventional plasma display panel in which address operation and memory operation are carried out by the same electrode, there has been previously proposed a memory sheet type plasma display panel (see Japanese patent application No. 4-74603 and Japanese patent application No. 3-356127 which claims the right of priority).

FIG. 3 is a perspective view showing a fundamental structure of the plasma display panel of memory sheet type in an exploded fashion. As shown in FIG. 3, the plasma display panel of memory sheet type includes address X and Y electrode groups 1 and 2 formed in an XY matrix fashion and a memory A electrode 3 and a memory B electrode 4 which form a pair of common electrodes. More specifically, as shown in FIG. 3, the address X electrode 1 is made of a transparent conductive material on a front glass plate 5 and the electrode surface thereof is exposed in gas space. The other address Y electrode 2 is disposed on a rear glass plate 6 and the electrode surface thereof is exposed in the gas space similarly. Therefore, the two electrode groups operate as an ordinary DC type plasma display panel in which the address X electrode 1 is used as an anode and the address Y electrode 2 is used as a cathode.

The memory A electrode 3 and the memory B electrode 4 are both made of a single metal plate and have through-holes at the positions corresponding to intersection points of the XY matrix formed by the above-mentioned first address X electrode 1 and second address Y electrode 2. Further, each of the metal plates forming the memory A electrode 3 and the memory B electrode 4 is coated on its whole surface including the inner wall of the through-holes with an insulating layer, such as a glass material or the like.

Fundamental operation of the above plasma display panel is to hold a discharge caused by the address electrode by the two memory A electrode 3 and memory B electrode 4. This memory sheet type plasma display panel is simple in operation similarly to the DC type plasma display panel and also has the same memory function as that of the AC type plasma display panel. Therefore, the memory sheet type plasma display panel is expected as one of promising plasma display panels having a bright picture screen. However, a method for effectively driving the plasma display panel of memory sheet type is not yet proposed.

In the method of driving the conventional three-electrode surface discharge type plasma display panel having the structure in which the address operation and the memory operation are effected by the same electrode, voltages of complex waveforms must be applied to the electrodes at high speed. As a result, a manufacturing cost of circuits is increased and operation thereof become unstable, which is one of the factors that hinder the display apparatus from being put into practical use. Further, a method of effectively driving the aforesaid memory sheet type plasma display panel also is not yet proposed.

OBJECTS AND SUMMARY OF THE INVENTION

Therefore, it is an object of the present invention to provide an improved method of driving an indicator tube in which the aforesaid shortcomings and disadvantages of the prior art can be eliminated.

More specifically, it is an object of the present invention to provide a method of driving an indicator tube in which a wall charge on the surface of a memory electrode can be erased or formed only by keeping respective electrode potentials at a memory sheet at constant potential during the address period while effectively utilizing specific features of a structure of a memory sheet type plasma display panel newly proposed.

It is another object of the present invention to provide a method of driving an indicator tube in which the indicator tube can be operated reliably.

According to a first aspect of the present invention, there is provided a method of driving an indicator tube comprised of a pair of common memory electrode plates and independent address XY electrode groups separate therefrom which comprises the steps of, in a case where an address discharge is to be carried out by the XY electrode groups from a state that no wall charge uniformly exists on wall surfaces of the pair of memory electrodes in all cells on a picture screen or on a line to be addressed, holding one of the pair of memory electrodes at a potential higher than a discharge space potential generated by an address discharge in a range such that a discharge is not caused on the low voltage side of the address electrode during an address period, holding the other of the pair of memory electrodes at a potential lower than the discharge space potential in a range such that a discharge is not caused on the high voltage side of the address electrode, selectively accumulating charged particles generated by the address discharge in cells disposed at the positions corresponding to an image as negative and positive wall charges, and continuously effecting a display discharge, or memory discharge utilizing a presence or absence of the wall charges as position information.

In accordance with a second aspect of the present invention, there is provided a method of driving an indicator tube comprised of a pair of common memory electrode plates and independent address XY electrode groups therefrom which comprises the steps of, in a case where an address discharge is to be carried out by the XY electrode groups from a state that positive and negative wall charges uniformly exist on wall surfaces of the pair of memory electrodes in all cells on a picture screen or on a line to be addressed, holding both potentials of the pair of memory electrodes at substantially the same potentials as a discharge space potential generated by the address discharge during an address period, selectively erasing wall charges accumulated in wall surfaces of the pair of memory electrodes by a re-combination of the wall charges with charged particles generated by the address discharge in response to a picture, and continuously effecting a display discharge, or memory discharge utilizing a presence or absence of the wall charges as position information.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

The present invention will now be described with reference to the drawings.

Roughly classifying, there are two kinds of methods of forming a picture of a memory AC type plasma display panel. One method is to energize necessary cells in response to a picture from the state that a whole picture screen is in its disabled state. The other method is to disable unnecessary cells in response to the picture from the state that whole cells are energized once regardless of the display picture screen. A first embodiment of the present invention corresponds to the former method and a second embodiment of the present invention correspond to the latter method.

Figure 1:
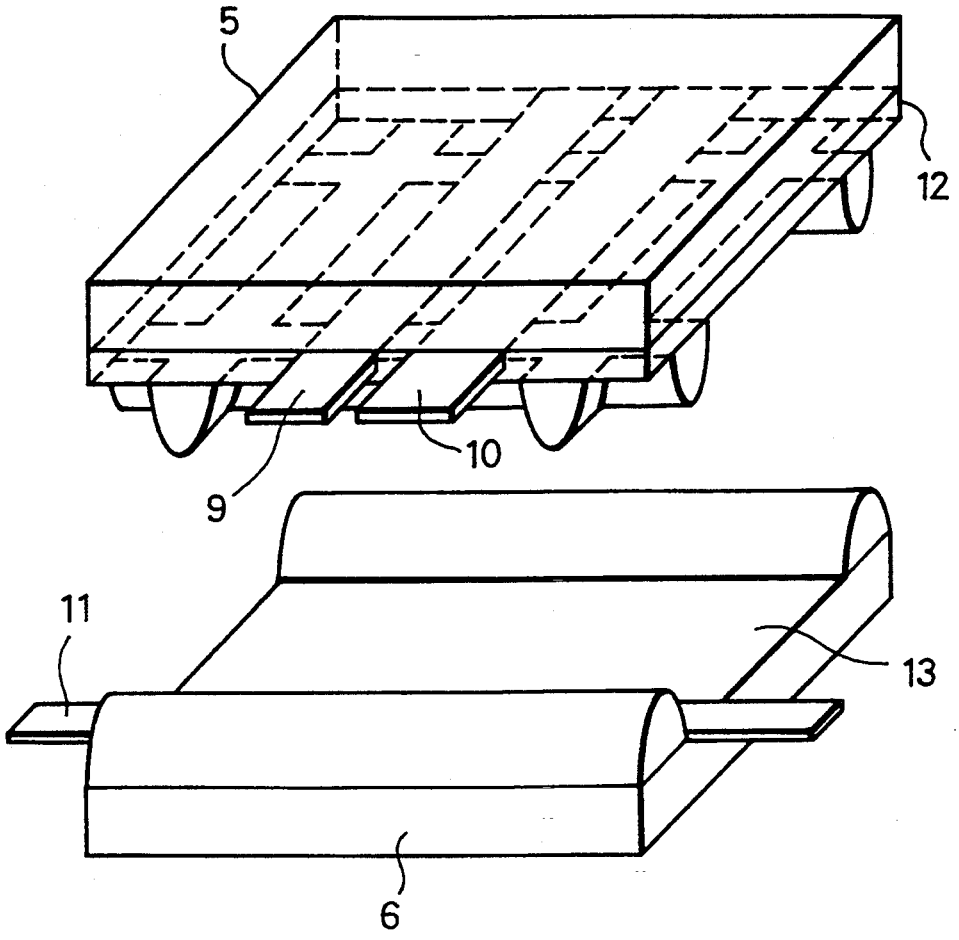
FIG. 1 (PRIOR ART)
FIG. 1 is a perspective view showing an example of a conventional three-electrode surface discharge plasma display panel of AC type in an exploded fashion.
Figure 2:
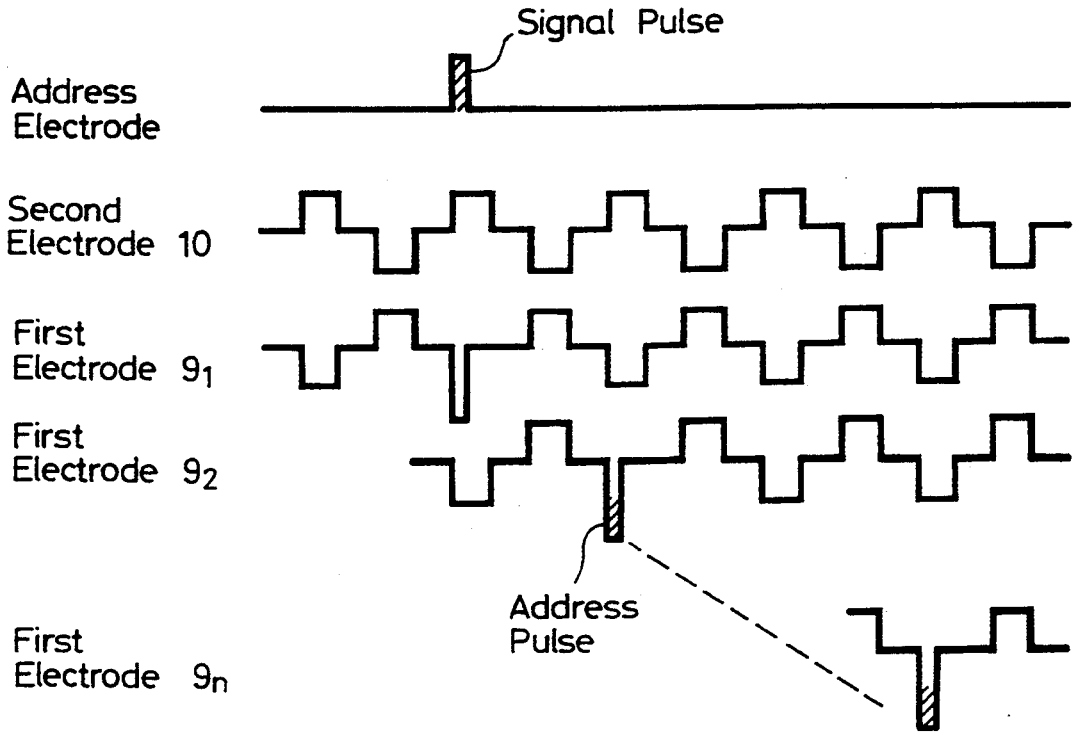
FIG. 2 (PRIOR ART)
FIG. 2 is a timing chart of respective pulses applied to the three-electrode surface discharge plasma display panel of AC type shown in FIG. 1.
Figure 3:
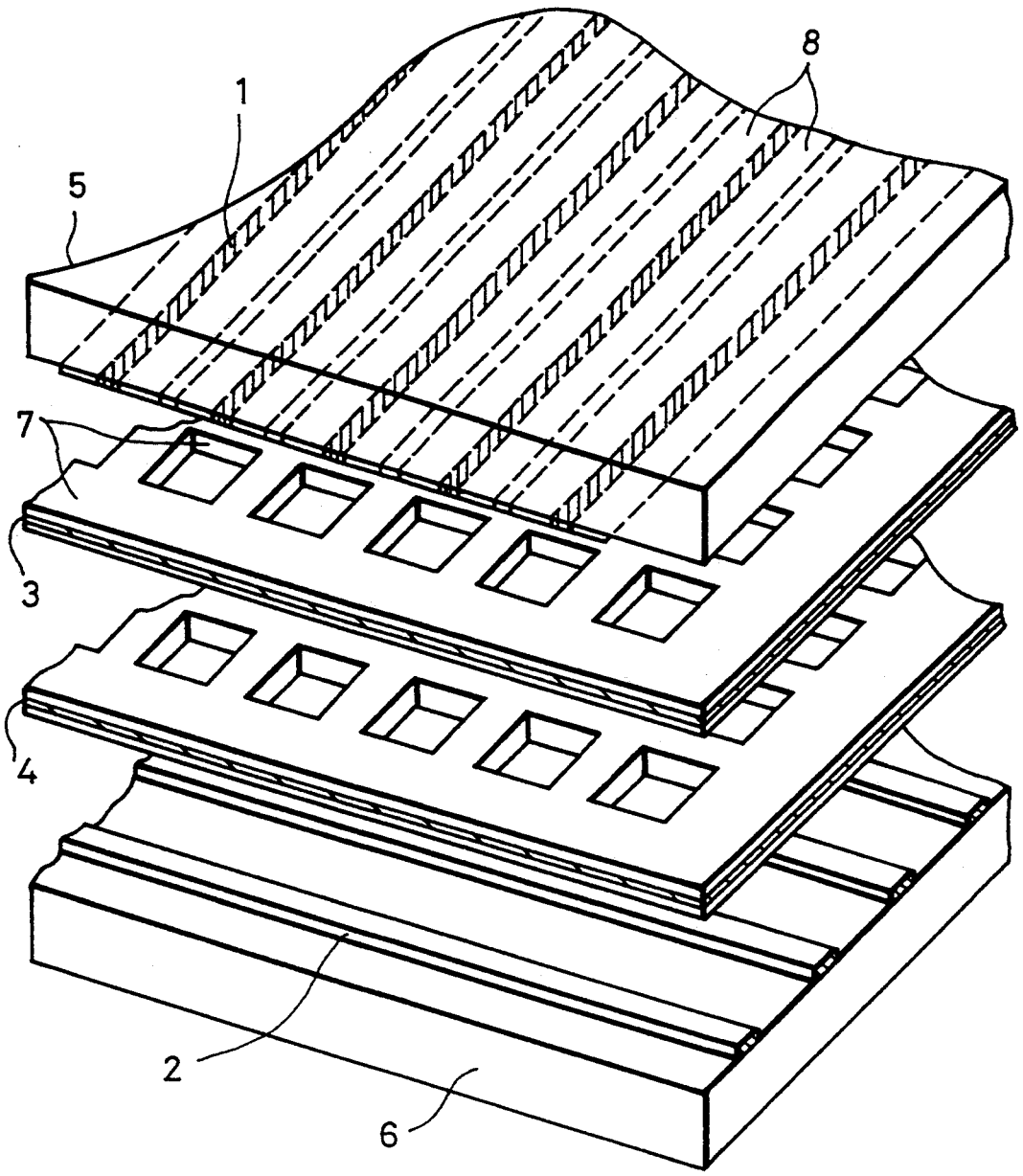
FIG. 3 (PRIOR ART)
FIG. 3 is a perspective view showing an example of a conventional memory sheet type plasma display panel in an exploded fashion.
Figure 4:
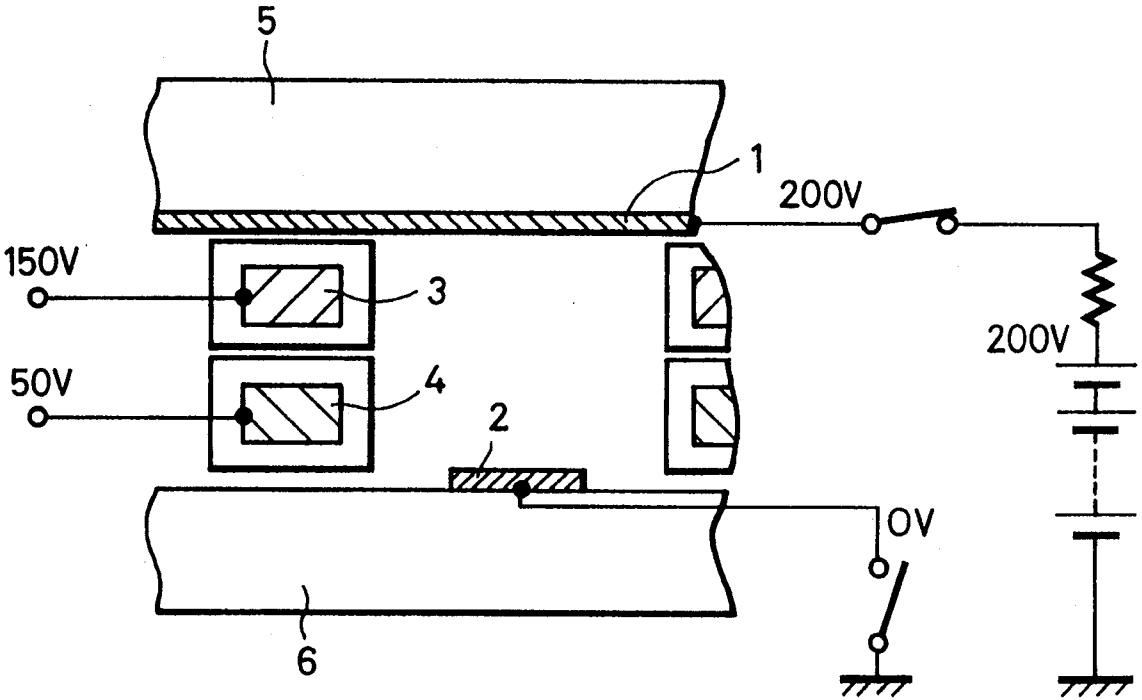
FIG. 4 is a fragmentary cross-sectional view used to explain action of a first embodiment of the present invention, and illustrating the condition that a discharge just occurs.
Figure 5:
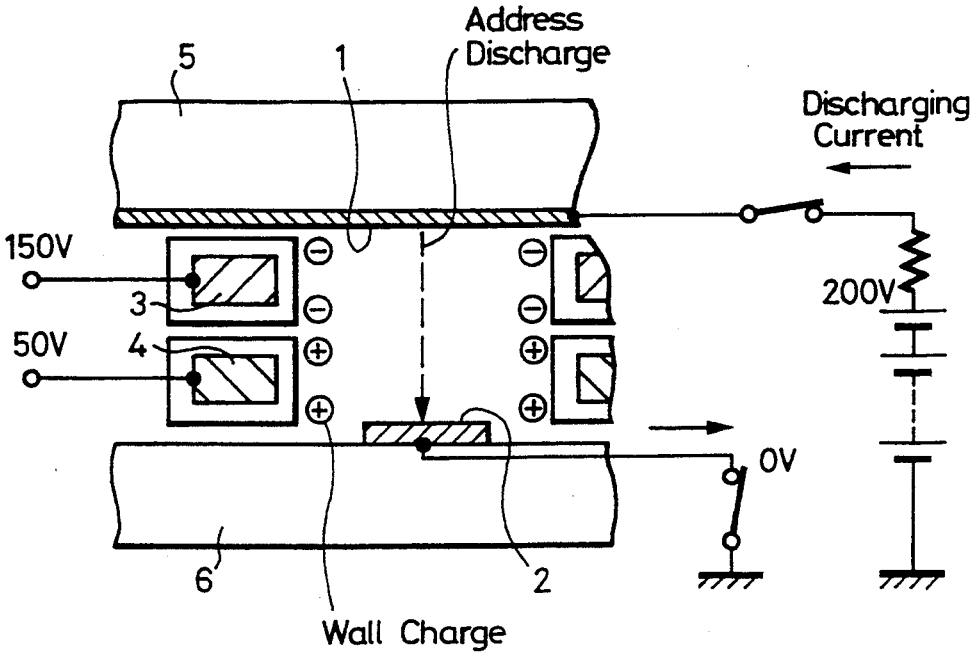
FIG. 5 is a fragmentary cross-sectional view used to explain action of the first embodiment of the present invention, and illustrating the condition that a wall discharge is formed.
Figure 6:
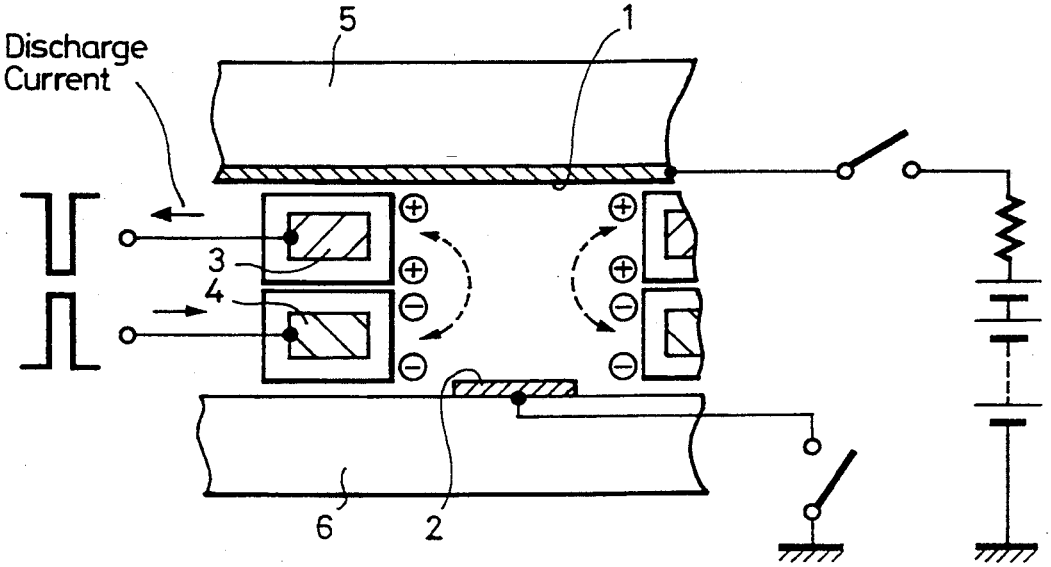
FIG. 6 is a fragmentary cross-sectional view used to explain action of the first embodiment of the present invention, and illustrating the condition that a pulse for maintaining a memory discharge is applied between memory electrodes.

Action of a driving method according to the first embodiment of the present invention will hereinafter be described with reference to FIGS. 4, 5 and 6. FIGS. 4, 5 and 6 are fragmentary cross-sectional views each showing one cell of the memory sheet type plasma display panel. When this plasma display panel is driven by the first embodiment of the driving method according to the present invention, wall charges are eliminated by carrying out erasing and discharging before an address signal is applied because it is supposed that no wall charge is produced on the surface of the insulating layers of the memory A electrode 3 and the memory B electrode 4. A wall charge is eliminated as follows. That is to say, when a wall charge is eliminated from the whole surface simultaneously, a voltage sufficient for generating a discharge is applied between the memory A electrode 3 and the memory B electrode 4 to cause a discharge in all cells simultaneously under the condition that the address X electrode 1 and the address Y electrode 2 are not applied with a signal. Thereafter, if the memory A electrode 3 and the memory B electrode 4 are both immediately held at the same potential as the discharge space potential, then the wall charge is erased and a new wall charge is not accumulated.

FIG. 4 shows the condition that the memory A electrode 3 is held at potential higher than the discharge space potential, for example, about 150 V if the discharge space potential is about 100 V, the memory B electrode 4 is held at potential lower than the discharge space potential, for example, about 50 V and the address X electrode 1 and the address Y electrode 2 are applied with potentials sufficient for generating an address discharge, for example, 200 V and 0 V, respectively so that a discharge just occurs.

FIG. 5 shows the condition that the address discharge is started and a charged particle generated is electrified on the memory A electrode 3 and the memory B electrode 4 to form a wall charge. That is to say, by the aforesaid distribution of the potentials, a negative wall charge is formed on the memory A electrode 3 and a positive wall charge is formed on the memory B electrode 4.

Thereafter, the address signal is sequentially supplied to the next cell. During that period, the potentials of the memory A electrode 3 and the memory B electrode 4 are held at the same potentials, i.e., about 150 V and about 50 V, respectively. Further, the anode side of the address electrode is held at a bias potential where unnecessary discharge does not occur, e.g., about 100 V so that, even when an address signal voltage to other cells is applied to the anode side of the address electrode, such wall charge is maintained as it is.

FIG. 6 shows the condition that a maintaining pulse for memory discharge is applied between the memory A electrode 3 and the memory B electrode 4 after the address operation of one picture screen was ended. That is to say, similarly to operation of the ordinary plasma display panel of AC type, a cell in which an electric field generated by the wall charge is superimposed upon the maintaining pulse is discharged and the cell which is not address and in which a wall charge is not accumulated is not discharged.

Action of a driving method according to the second embodiment of the present invention will be described below with reference to FIG. 7, 8 and 9. When the plasma display panel is driven by the driving method of the second embodiment of the present invention, all cells are temporarily discharged before the application of the address signal to thereby form a wall charge because it is assumed that wall charges are uniformly accumulated on the surfaces of the insulating layers of the memory A electrode 3 and the memory B electrode 4. The method of forming a wall charge is not shown because of reasons similar to those described above. When a wall charge is simultaneously formed on the whole picture screen, for example, a voltage sufficient for generating a discharging is applied between the memory A electrode 3 and the memory B electrode 4 to thereby generate a discharge in all cells simultaneously and the memory A electrode 3 and the memory B electrode 4 are held at the corresponding potentials. Then, even when the memory A electrode 3 and the memory B electrode 4 are held at the proper same potential, e.g., about 100 V of the discharge space potential after the discharge was ended, the wall charge is held as it is because no charged particle exists in the space.

Figure 7:
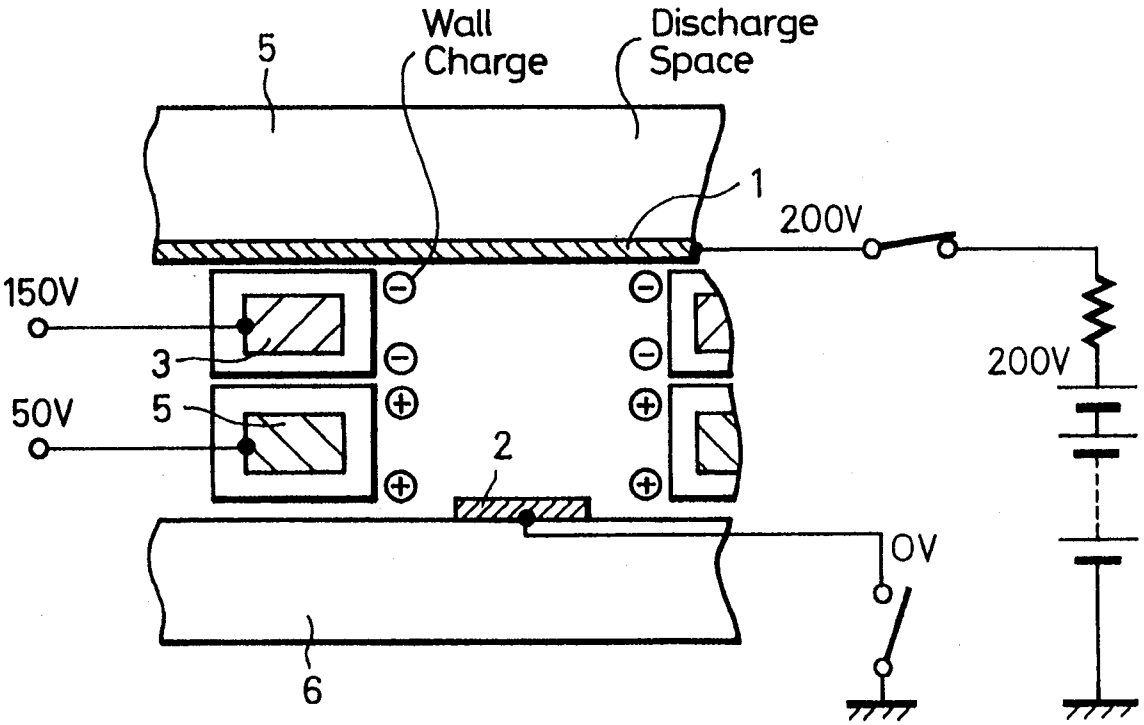
FIG. 7 is a fragmentary cross-sectional view used to explain action of a second embodiment of the present invention, and illustrating the condition that a discharge just occurs.

FIG. 7 shows the condition that the memory A electrode 3 and the memory B electrode 4 are both held at about 100 V and the address X electrode 1 and the address Y electrode 2 are applied with potentials sufficient for generating an address discharge, e.g., about 200 V and about 0 V, respectively so that, a discharge just occurs.

Figure 8:
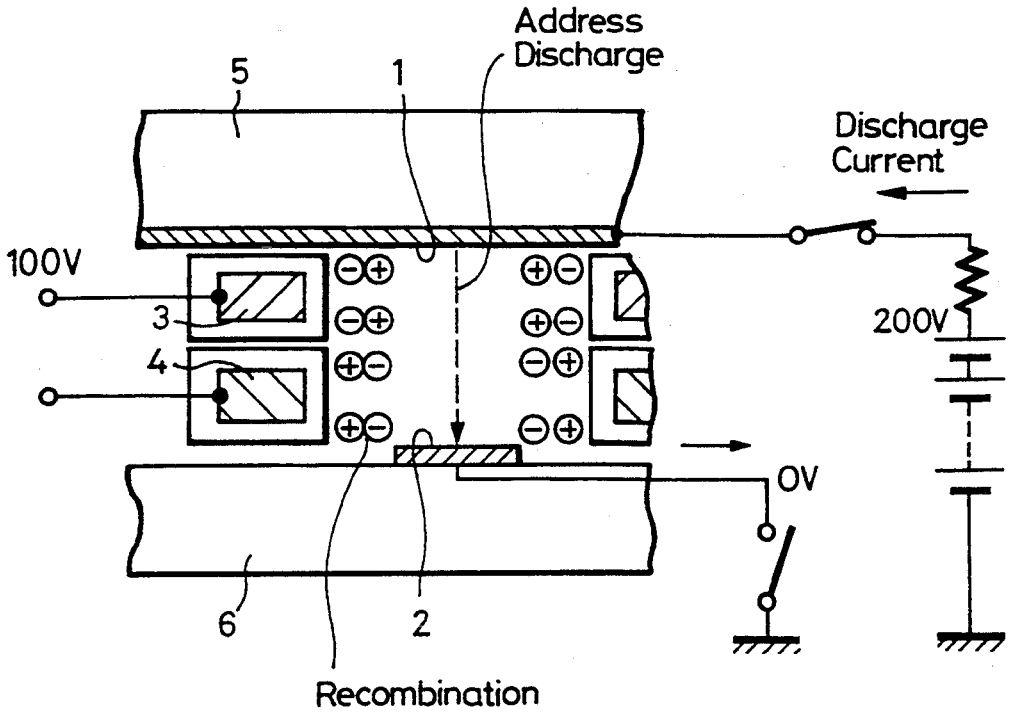
FIG. 8 is a fragmentary cross-sectional view used to explain action of the second embodiment of the present invention, and illustrating the condition that a charged particle is re-combined with a wall charge on a memory electrode so as to erase the wall charge.

FIG. 8 shows the condition that the address discharge is started and a charged particle produced is re-combined with a wall charge on the memory electrode to thereby erase the wall charge. While the address X electrode 1 and the address Y electrode 2 are both held at the same bias potential, i.e., about 100 V, due to the wall charge, the surface of the memory A electrode 3 is held at a lower potential, e.g., about 50 V and the surface of the memory B electrode 4 is held at a higher potential, e,g., about 150 V. Consequently, positive and negative particles in the discharged space are attracted by the memory electrodes 3 and 4 and recombined with the wall charges on the surfaces of the memory electrodes 3 and 4. Thereafter, the address signal is sequentially supplied to the next cell. During that period, the potentials of the memory A electrode 3 and the memory B electrode 4 are held at the same condition so that the state of the wall charge of each cell is maintained as it is so long as there occurs no new discharge.

Figure 9:
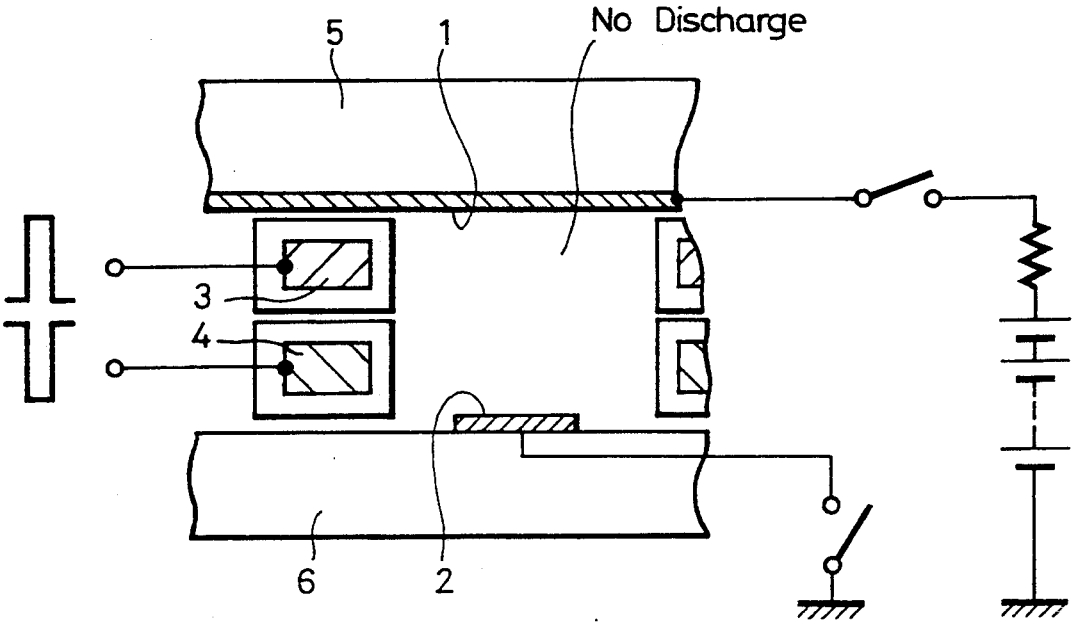
FIG. 9 is a fragmentary cross-sectional view used to explain action of the second embodiment of the present invention, and illustrating the condition that a pulse for maintaining a memory discharge is applied between memory electrodes.

FIG. 9 shows the condition that the maintaining pulse for memory discharge is applied between the memory A electrode 3 and the memory B electrode 4 after the addressing of one picture screen is ended. In other words, although the cell in which the wall charge remains is discharged when the electric field generated by the wall charge is superimposed upon the maintaining pulse similarly to the operation of the ordinary AC type plasma display panel, a cell in which the wall charge is erased as shown in FIG. 9 is not discharged.

The practical driving method according to the first and second embodiments of the invention will be described with reference to timing charts of applied pulses forming FIGS. 10 and 11.

There are two kinds of timing relationships that the memory AC type plasma display panel is moved from the address discharge to the memory discharge. It is customary that the addressing is carried out in a line sequential system in any one of the two timing relationships. One timing relationship is that the cells are energized immediately after the addressing is carried out. The other timing relationship is that all cells are energized simultaneously after a wall charge used as position information was accumulated in each cell and the addressing of one picture screen was ended. While the driving methods according to the first and second embodiments of the invention are effectively applied to the plasma display panel of memory AC type, the latter case will be described for simplicity.

Figure 10:
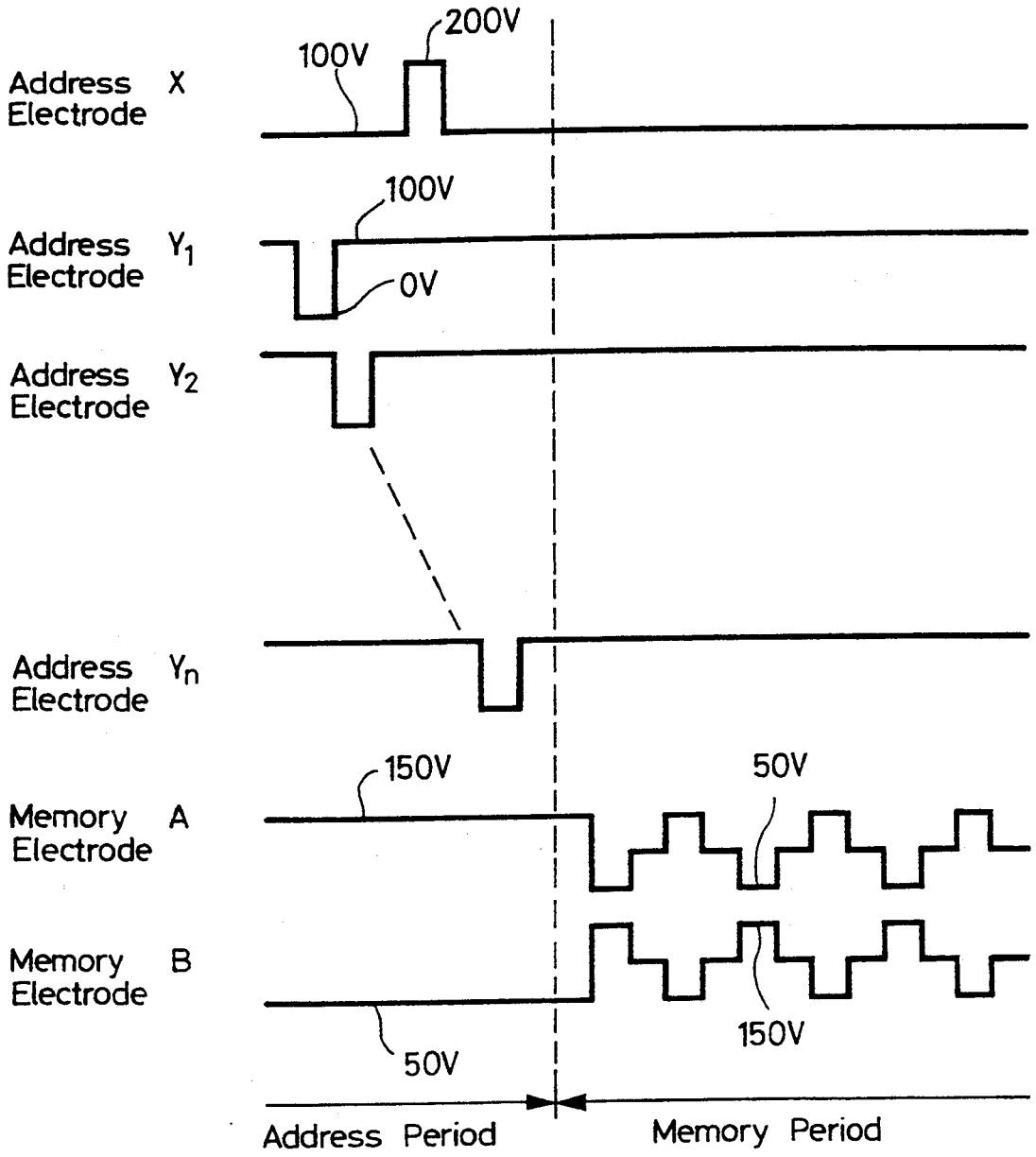
FIG. 10 is a timing chart of respective pulses used in the first embodiment of the present invention.

FIG. 10 is a timing chart of the driving method according to the first embodiment of the present invention. Initially, in order to erase the wall charges simultaneously prior to the addressing, all cells are simultaneously discharged by the application of a reset pulse, though not shown. Various methods are available in order to apply the reset pulse. In this case, if a reset pulse voltage sufficient for starting the discharge is applied between the memory A electrode 3 and the memory B side 4 and the memory A electrode 3 and the memory B electrode 4 are later held at substantially the same potential as the discharge space potential, then the wall charge is erased as described before.

Since the electrode of the address electrode is exposed in the gas space, the address discharge is effected in a line sequential fashion in exactly the same manner as that of the ordinary DC type plasma display panel. Although the memory A electrode 3 is held at a potential higher than the discharge space potential, e,g., about 150 V if the discharge space potential is about 100 V and the memory B electrode 4 is held at a potential lower than the discharge space potential, e.g., about 50 V during the address period, such potentials at which the memory A electrode 3 and the memory B electrode 4 are held do not affect the start of the address discharge. If the address discharge occurs under this condition, a charged particle generated is electrified on the memory A electrode 3 and the memory B electrode 4 to form wall charges.

With the aforesaid distribution of the potentials, a negative wall charge is formed on the memory A electrode 3 and a positive wall charge is formed on the memory B electrode 4. The address operation is carried out from the line of the uppermost portion to the line of the lowermost portion in a line sequential fashion.

During the address operation period, a wall charge corresponding to picture information is formed in each cell. During the memory operation period, although an AC discharge maintaining pulse shown in FIG. 10 is applied between the memory A electrode 3 and the memory B electrode 4, due to the presence or absence of wall charge, a cell in which the electric field produced by the wall charge is superimposed upon the discharge maintaining pulse is discharged and a cell which is not addressed and in which a wall charge is not accumulated is not discharged. Therefore, the discharge is continued on the picture screen during this period in accordance with image information.

Figure 11:
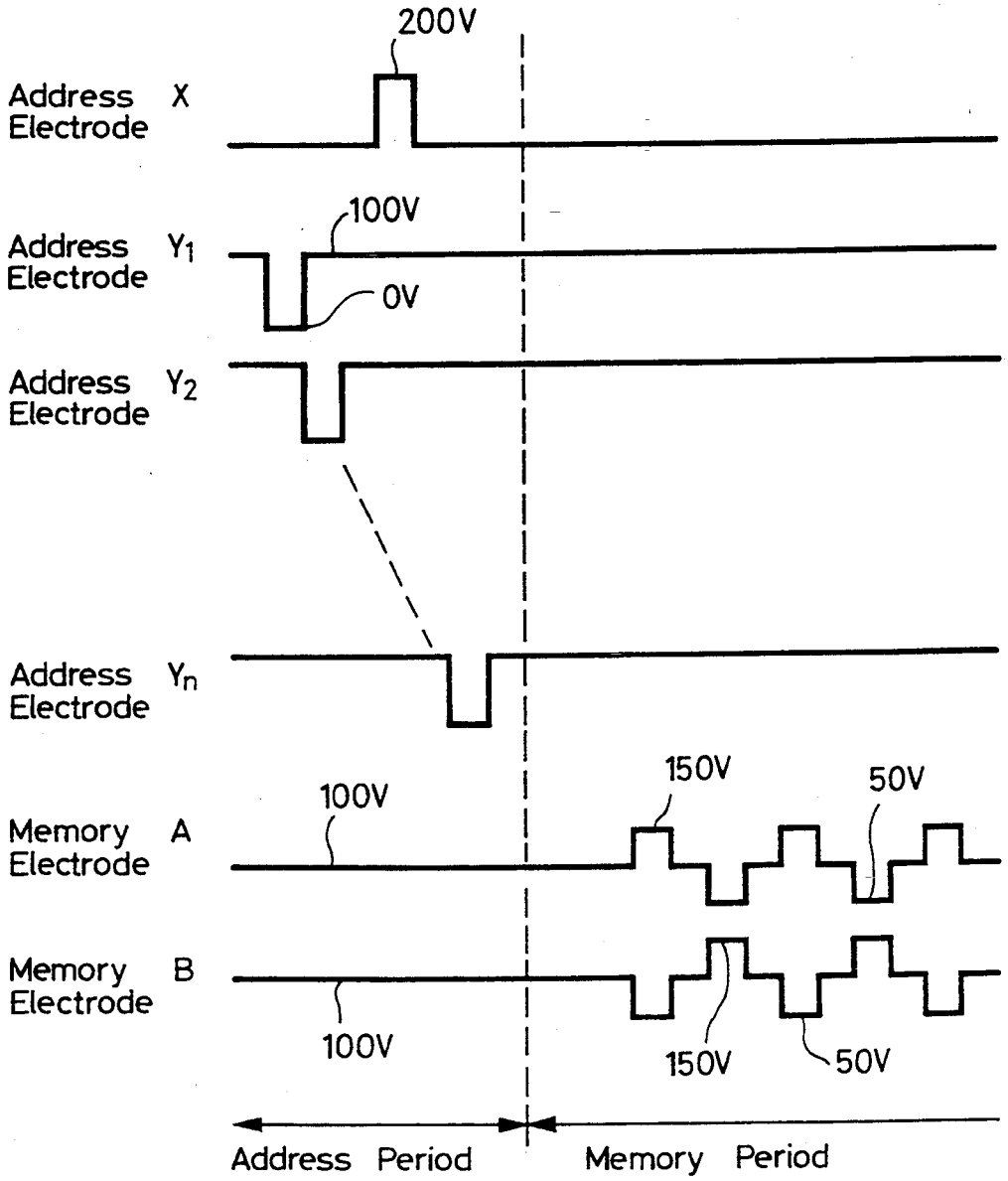
FIG. 11 is a timing chart of respective pulses used in the second embodiment of the present invention.

FIG. 11 is a timing chart used to explain a method of driving a plasma display panel according to the second embodiment of the present invention. Initially, all cells are simultaneously discharged by the application of a reset pulse in order to form wall charges simultaneously on the picture screen prior to the address operation. Various methods are available for the application of a reset pulse. In this case, if a reset pulse sufficient for starting the discharge is applied between the memory A electrode 3 and the memory B electrode 4 to hold the memory A electrode 3 and the memory B electrode 4 at the original potentials during the period in which the charged particle generated by the reset discharge exists in the discharge space or the memory A electrode 3 and the memory B electrode 4 are respectively held at potentials higher and lower than at least the discharge space potential, e.g., about 150 V and about 50 V, then the wall charges are maintained as they are. The wall charges are maintained as they are even when the potentials of the memory A electrode 3 and the memory B electrode 4 are both set to about 100 V which is substantially the same as the discharge space potential after a short period of time.

Under this condition, if the address discharge is carried out similarly as described above, the charged particles generated by the address discharge are re-combined with the wall charges on the wall surfaces of the memory A electrode 3 and the memory B electrode 4 to erase the wall charges. A wall charge in a cell in which the address discharge does not occur is left as it is.

During the above-mentioned address operation period, a wall charge corresponding to picture information is formed in each cell. Although the AC discharge maintaining pulse shown in FIG. 11 is applied between the memory A electrode 3 and the memory B electrode 4 during the memory operation period, due to the presence or absence of the wall charge, the cell in which the electric field generated by the wall charge is superimposed upon the discharge maintaining pulse is discharged and the cell in which the wall charge is erased is not discharged. Therefore, the picture screen is continuously energized and disabled at every cell during the memory operation period in accordance with image information.

Both in the first and second embodiments of the present invention, the driving method of the present invention is applied to the method in which the discharge is switched from the address discharge to the memory discharge when the cells are simultaneously energized after the wall charge had been temporarily accumulated in each cell as position information and the address discharge of one screen had been finished. On the other hand, in a method in which the discharge is continuously switched from the address discharge to the memory discharge, i.e., the memory discharge is carried out in a line sequential manner, it is needless to say that a relationship between the address discharge and the memory electrode potential which is the fundamental driving method of the present invention is perfectly similar. However, since the reset is carried out at every line prior to the addressing, the reset pulse is not applied to the memory A electrode 3 and the memory B electrode 4 but applied to the address X electrode 1 and the address Y electrode 2 at every line in a line sequential fashion prior to the addressing.

The aforementioned potential values are temporarily set in order to understand the present invention more clearly. While the discharge space potential, for example, is assumed to be about 100 V, it is needless to say that this discharge space potential presents different values depending upon gas composition, gas pressure, electrode material or the like. This is also true that the discharge starting voltage and the bias voltage are set to about 200 V and about 100 V, respectively.

As set out above, according to the present invention, the wall charge can be formed or erased by holding the potentials of the memory A electrode 3 and the memory B electrode 4 at the high potential and low potential or by holding the potentials of the memory A electrode 3 and the memory B electrode 4 at substantially the same potential as the discharge space potential during the address discharge period. It is needless to say that the upper and lower limits of the high and low potentials are set in a range sufficient so that unnecessary discharge can be prevented from occurring relative to the address X electrode 1 or address Y electrode 2.

Further, unlike the prior art in which the address signal voltage and the memory voltage must be applied to the address line at restricted timing at high speed so that the driving circuit cannot be made inexpensive, according to the present invention, the address operation and the memory operation can be separated completely so that the operation becomes stable. In addition, the operation speed can be reduced considerably and hence the manufacturing cost of the driving circuit can be reduced considerably.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A method for driving an indicator tube having a pair of common memory electrode plates, each of which is formed of an electrode and an insulating layer coated on said electrode, and independent address XY electrode groups separate therefrom, comprising the steps of:

in a case where an address discharge is to be carried out by said XY electrode groups from a state that no wall charge uniformly exists on wall surfaces of said pair of memory electrodes in all cells on a picture screen or on a line to be addressed, holding one of said pair of memory electrodes at a potential higher than a discharge space potential generated by an address discharge in a range such that a discharge is not caused on the low voltage side of said address electrode groups during an address period;

holding the other of said pair of memory electrodes at a potential lower than said discharge space potential in a range such that a discharge is not caused on the high voltage side of said address electrode groups;

selectively accumulating charged particles generated by the address discharge in cells disposed at the positions corresponding to an image as negative and positive wall charges on surfaces of said insulating layers of said pair of common memory electrode plates; and continuously effecting a display discharge, or memory discharge utilizing a presence or absence of said wall charges as position information.

2. A method for driving an indicator tube having a pair of common memory electrode plates, each of which is formed of an electrode and an insulating layer coated on said electrode, and independent address XY electrode groups therefrom, comprising the steps of:

in a case where an address discharge is to be carried out by said XY electrode groups from a state that positive and negative wall charges uniformly exist on wall surfaces of said insulating layers of said pair of common memory electrodes in all cells on a picture screen or on a line to be addressed, holding both potentials of said pair of common memory electrode plates at substantially the same potentials as a discharge space potential generated by said address discharge during an address period;

selectively erasing wall charges accumulated on said surfaces of said insulating layers of said pair of memory electrode plates by a recombination of said wall charges with charged particles generated by said address discharge in response to a picture; and continuously effecting a display discharge, or memory discharge utilizing a presence or absence of said wall charges as position information.

* * * * *